US007393244B1

(12) United States Patent
Brodsky et al.

(10) Patent No.: US 7,393,244 B1
(45) Date of Patent: Jul. 1, 2008

(54) METHOD AND APPARATUS FOR RESTRICTING ROTATIONAL MOMENT ABOUT A LONGITUDINAL AXIS OF SMT CONNECTORS

(75) Inventors: William L. Brodsky, Binghamton, NY (US); Amanda E. E. Mikhail, Rochester, MN (US); Scott A. Shurson, Mantorville, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/683,519

(22) Filed: Mar. 8, 2007

(51) Int. Cl.
*H01R 13/60* (2006.01)

(52) U.S. Cl. ..... 439/567; 439/572

(58) Field of Classification Search ..... 439/567, 439/572, 571, 573, 566
See application file for complete search history.

(56) References Cited

U.S. PATENT DOCUMENTS 4,679,883 A * 7/1987 Assini et al. ..... 439/607
4,824,398 A * 4/1989 Taylor ..... 439/557
5,281,166 A * 1/1994 Yu et al. ..... 439/571
6,024,603 A * 2/2000 Chen et al. ..... 439/571
6,086,416 A * 7/2000 Choy ..... 439/567
6,168,464 B1 * 1/2001 Choy et al. ..... 439/567
6,454,599 B1 * 9/2002 Wu ..... 439/567
6,478,617 B2 * 11/2002 Fan ..... 439/570
6,540,540 B1 * 4/2003 Tobey ..... 439/327
6,579,111 B2 * 6/2003 Fukamachi ..... 439/247
6,579,123 B2 * 6/2003 Kasahara ..... 439/573
6,722,908 B2 * 4/2004 Llapitan et al. ..... 439/327
6,736,659 B1 * 5/2004 Wu ..... 439/247
6,923,679 B1 * 8/2005 Wu ..... 439/573
2005/0032420 A1 * 2/2005 Iwasaki ..... 439/571

* cited by examiner

*Primary Examiner*—Tulsidas C. Patel
*Assistant Examiner*—Vladimir Imas
(74) *Attorney, Agent, or Firm*—Cantor Colburn LLP

(57) ABSTRACT

An apparatus for supporting at least one electrical connector body, the apparatus includes a connector housing mountable to a printed circuit board (PCB). The connector housing includes at least one base member for attachment to the PCB; and at least one support post each spaced apart from one another and extending from the at least one base member. The support posts inserted into one or more clearance holes in the PCB are configured to receive the one or more support posts. When a lateral force is applied to the connector body, the support posts acts as a support and transfers the lateral force to the PCB, thereby reducing a rotational moment at a base of each connector body connected to the PCB.

10 Claims, 5 Drawing Sheets

METHOD AND APPARATUS FOR RESTRICTING ROTATIONAL MOMENT ABOUT A LONGITUDINAL AXIS OF SMT CONNECTORS

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

Field of the Invention

This invention relates to a method and apparatus for restricting a rotational moment about a longitudinal axis of surface-mount (SMT) connectors, and particularly to a method and apparatus for restricting the rotational moment about the longitudinal axis of SMT DIMM Sockets and other SMT connectors.

DESCRIPTION OF BACKGROUND

In computer systems such as personal computers, a socket is referred to as an electrical connector generally mounted on a motherboard (main board) in order to connect extension boards such as extended interface boards for peripheral devices or extended memory boards to the motherboard. The motherboard and extension boards can be electrically connected by plugging the extension boards into the electrical connector.

The structure of a common electrical connector will be described here with the example of an electrical connector used to connect an extension memory module (hereinafter, "module") referred to as a DIMM (dual in-line memory module) as illustrated in FIGS. 1 and 2. This module corresponds to the extension board described above.

A dual in-line memory module (DIMM) is more and more popular for use in the present PC industry, and thus uses a DIMM socket connector mounted on the motherboard for mechanical and electrical interconnect of the corresponding DIMM therein for signal transmission between the motherboard and the DIMM. A main feature of the typical DIMM connector as illustrated in FIGS. 1 and 2 is that the DIMM connector 10 includes generally a pair of latch/eject members 12 at its two opposite ends so that such DIMM may not only be properly retained in the DIMM connector 10 without possibility of inadvertent withdrawal by vibration or external impact, but also easily ejected from the DIMM connector 10 by rotational movement of the latch/eject member 12.

With more of the industry moving to SMT (Surface Mount Technology) connectors due to PCB wiring density, path length, and electrical signal integrity concerns, new mechanical requirements emerge due to the delicate SMT interface, compared to the more mechanically robust compliant pin and pin-through-hole interfaces in previous applications. This disclosure addresses the forces and strains incurred at the SMT solder joint and pad interface due to rotation about the long axis of an SMT DIMM socket or housing 14, for example, as well as the possibility of pad delamination at the card surface, by minimizing the overall rotation about the longitudinal axis of the SMT DIMM socket, as illustrated in FIG. 2.

Rotation about the longitudinal axis of the SMT DIMM socket 14 is caused by a number of factors. One factor is the amount and location of the center of mass of the DIMM module (not shown). The module acts as a cantilevered beam when assembled into the socket 10, where shock, vibration, and dead load effects can all contribute to moments being applied to the DIMM connector 10, particularly when the DIMM module is plugged parallel to the ground and perpendicular to a motherboard 16 on which the DIMM connector 10 is surface mounted thereto. Another factor is due to the design of the connector 10 itself, allowing rotation of the DIMM module upon insertion. The traditional DIMM socket allows approximately 10 degrees of rotation centered about a perpendicular plane to a printed circuit board (PCB) surface defined by the motherboard 16. This allowable rotation, coupled with the high insertion forces required to mate the interface between the DIMM module and the socket, results in a high lateral load forming a torsional moment 17 (e.g., "rotational moment" in FIG. 2) about the longitudinal axis of the connector inducing an undesirable shear stress to the SMT joint and PCB pad, regardless of orientation of the module and connector with respect to gravity. The rotational moment results in a lifting stress at the connector PCB interface indicated with arrow 18 in FIG. 2. This stress to the SMT joints, as well as the SMT pad, creates a reliability concern, and the possibility of pad delamination.

Previous designs were mechanically anchored to the PCB via the pin-through-hole or compliant pin nature of the PCB leads, as discussed above which provided a larger reaction force to the lateral shear and torsional moments than the present SMT joints provide. With the present surface-mount design, the reaction forces are carried through the SMT joints and PWB solder pads, which are not as robust as pin-in-hole connections to withstand such forces, and pose a reliability concern.

SUMMARY OF THE INVENTION

The shortcomings of the prior art are overcome and additional advantages are provided through the provision of an apparatus for supporting at least one electrical connector body. The apparatus includes at least one surface mount connector body having at least one support post, and the PCB. The support post is molded or integrated into the connector body. The PCB utilizes clearance holes to accept the one or more Support posts. The support posts may be soldered to the PCB, press fit into the PCB clearance hole, or a back side retainer may be attached to the support post on the back side of the PCB. When a lateral force is applied to the connector body, the support post(s) acts as a support and transfers the lateral force to the PCB, thereby reducing a rotational moment at a base of each connector body connected to the PCB.

In another exemplary embodiment, a system includes: a motherboard; a plurality of electrical connectors surface mounted to the motherboard, each electrical connector including a connector body configured to receive and electrically connect an electrical module. The connector body includes at least one base member for attachment to the motherboard; and at least one support post each spaced apart from one another and extending from the at least one base member. The support posts inserted into one or more clearance holes in the motherboard are configured to receive the one or more support posts. When a lateral force is applied to the rigid connector body, the frame assembly acts as a support and transfers the lateral force to the motherboard, thereby reducing a rotational moment at a base of each connector body connected to the motherboard Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Turning now to the drawings in greater detail, the structure of a common electrical connector will be described here with the example of an electrical connector used to connect an extension memory module (hereinafter, "module") referred to as a DIEM (dual in-line memory module). This module corresponds to the extension board described above.

Figure 1:
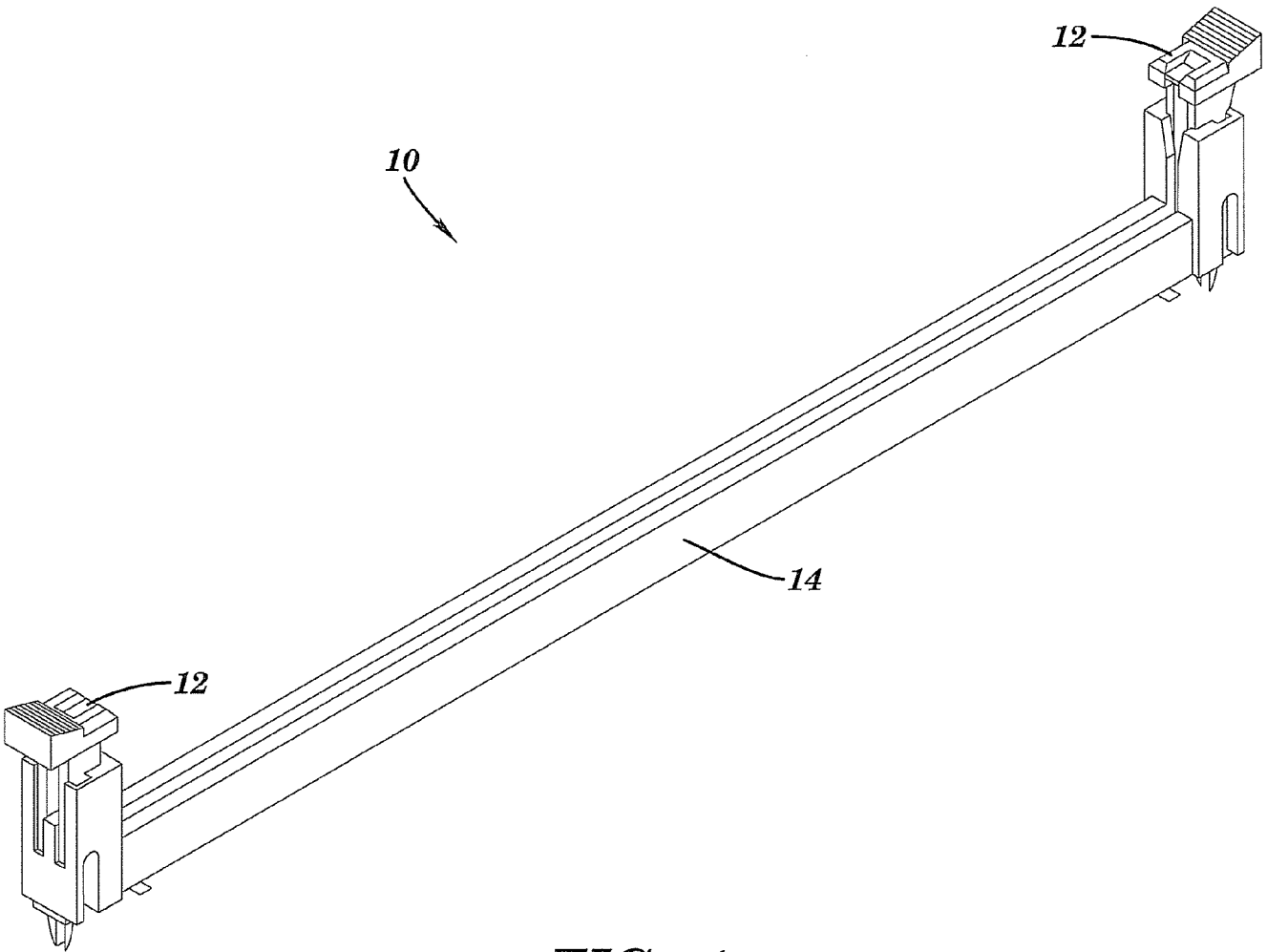
FIG. 1 illustrates a perspective view of a conventional DIMM connector.
Figure 3:
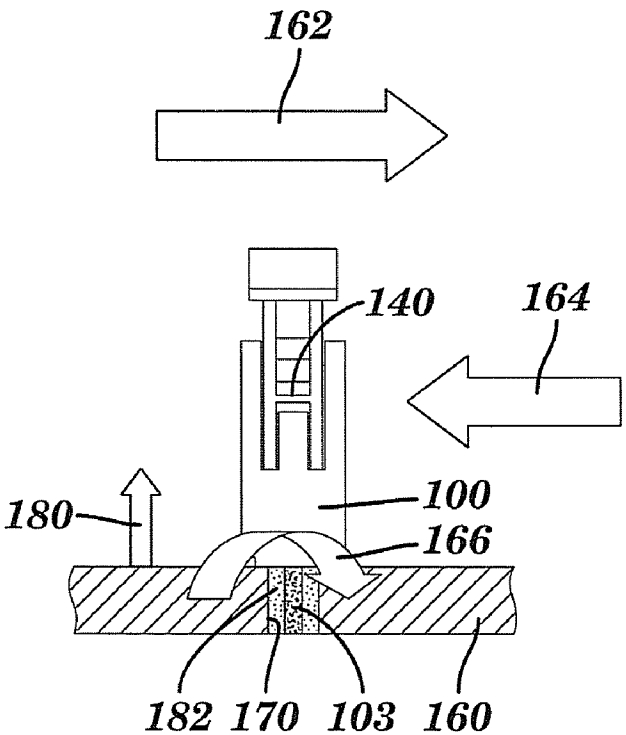
FIG. 3 illustrates an elevation end view of a DIMM connector having a support post mounted to a PCB surface of a motherboard according to a first exemplary embodiment.
Figure 2:
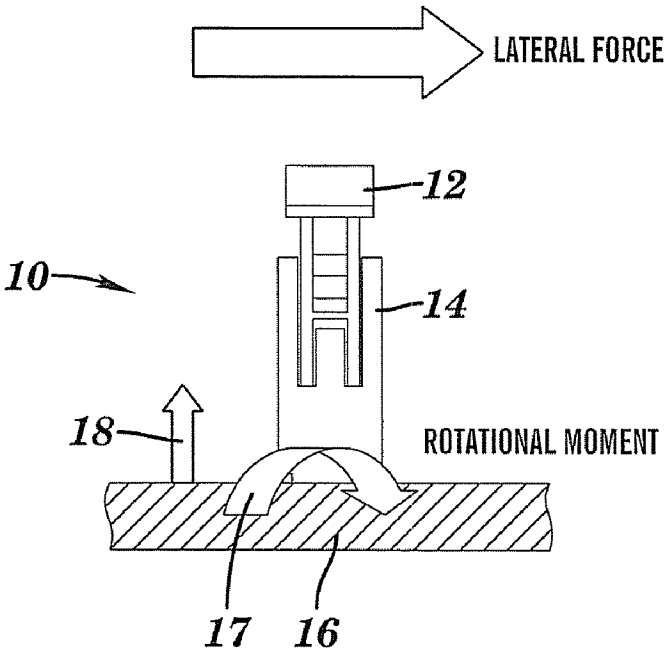
FIG. 2 illustrates an elevation end view of the DIMM connector of FIG. 1 surface mounted to a PCB surface of a motherboard (show module 14)

FIG. 3 is schematic elevation end view illustrating the structure of an electrical connector assembly 100 for a DIMM (not shown) according to the present invention. The electrical connector assembly 100 is an electrical connector which is used in desktop personal computers, for example. In FIG. 3, the connector assembly 100 is defined by a housing 140 for housing a respective module (not shown). The modules are arranged in several rows, for example, on a PCB or motherboard 160. The user inserts a module (not shown) in the housing 140, allowing memory to be added on. When the housing 140 is arranged standing up on the motherboard 160, as illustrated in FIG. 3, the module is held perpendicular to the motherboard 160. In order to counteract a lateral force indicated with arrow 162 when inserting a module (not shown) for electrical connection with the connector assembly 100, a reaction force indicated with arrow 164 may be applied to preserve the integrity of the SMT joint interface between the connector assembly 100 and the motherboard 160. The reaction force 164 is applied by exemplary Support pins or rigid support posts 103 extending from a bottom of the housing 140 and extending through a corresponding aperture 170 of the motherboard 160. The reaction force 164 reduces a rotational moment 166 about a longitudinal axis defined by the connector 100 assembly at the SMT joint interface between the connector assembly 100 and the motherboard 160 when the lateral force 162 is applied. FIG. 3 also indicates that the provision of the support pins or rigid support posts 103 extending from a bottom of the housing 140 and extending thorough a corresponding aperture 170 of the motherboard 160 reduce a rotational moment 166 and results in a reduced lifting stress at the connector/PCB interface as indicated by arrow 180.

In the exemplary embodiment illustrated in FIG. 3, the support post 103 includes soldered leads or anchors placed interstitially to the SMT contacts, providing mechanical anchoring through the board 160, and thus strain relief of the SMT joints. In this embodiment, a pin or support post 103 extends from a base of the housing 140 and is inserted into aperture 170 and then an annulus defined by a space between a wall of the board 160 defining the aperture 170 and a periphery of the support post 103 is filled with solder 182. The support post 103 surrounded with soldered within the aperture 170 provides an interference fit to the board 160, and thus anchorage of the connector is achieved after reflow of the solder 182.

In exemplary embodiments, the solderable support post 103 is a metal piece which can be inserted into the base of the connector assembly housing 140, similar to a board lock used in the industry. However, conventional board locks are for registration, and have no appreciable structural benefit.

Still referring to FIG. 3, it will be recognized by those skilled in the art that in the force diagram thereof, the opposite (reverse) would be true as well, as the support post 103 counteracts forces applied to both sides of the DIMM connector assembly 100. The force depicted in FIG. 3 would be induced by either a non-perpendicular plugging (which is allowed in the connector design), or by gravitational force if the overall assembly was rotated 90 degrees, as is typical in system applications.

The support posts 103 acting as interstitial braces can be applied to the connector assembly 100 in various ways, as described hereinbelow. In an exemplary embodiment as illustrated in FIG. 3, the support posts 103 are rigid body members extending from a base of the connector assembly 100 and fixed to the motherboard 160 via a fixing member, such as solder 182 as in FIG. 3, or other retaining means as discussed in further detail herein below. The fixing member may be a pin, screw, rivet, or any mechanical fastener that is known or will later become known.

The geometry of the support post 103 is not specific, as it can be designed for ease of disassembly/rework of the individual connector assemblies 100 in a ganged assembly, or other factors specific to the given application. One advantage to having the support posts 103 configured to allow removal from the motherboard 160 is that it allows for vertical removal of the DIMM connector assemblies 100 in rework. In other words, it is preferable that the support posts are not permanently mounted to the motherboard 160 so as to prevent removal in order to allow for potential removal of the connector assembly 100 from the motherboard 160. The reworkability of this design is an advantage over one large connector assembly with multiple slots of a ganged assembly. Instead of pulling off an entire large connector assembly with multiple slots in rework, an individual isolated connector assembly 100 can be removed without disturbing the adjacent connector assemblies 100 of a ganged assembly.

Figure 5:
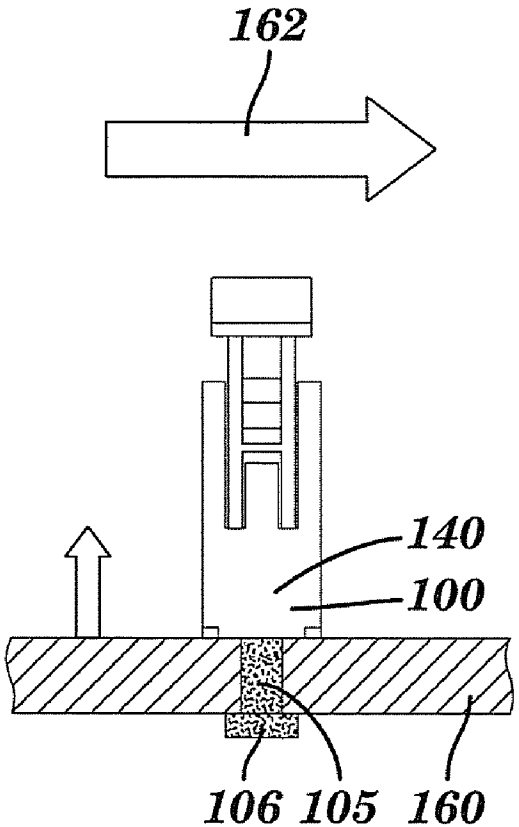
FIG. 5 illustrates an elevation end view of a DIMM connector mounted to a PCB surface of a motherboard, the connector having a support post utilizing a retaining member that retains the DIMM connector by attaching to the support post on the opposite surface of the PCB motherboard according to a third exemplary embodiment.
Figure 4:
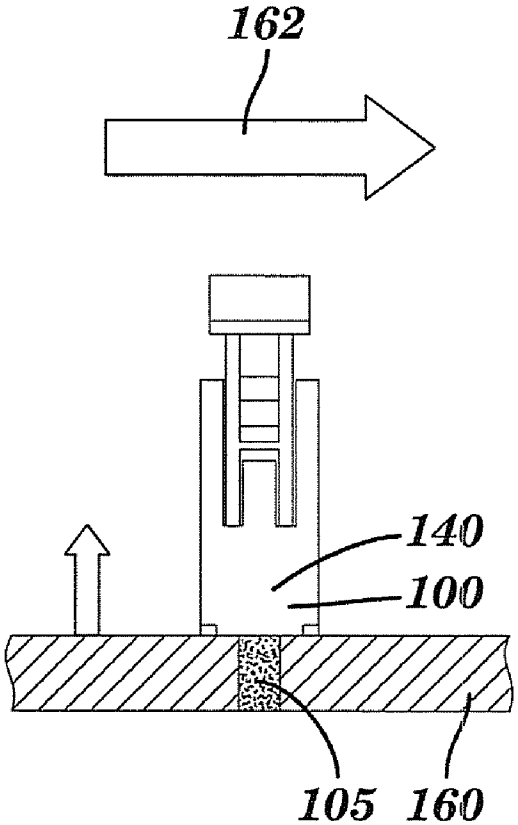
FIG. 4 illustrates an elevation end view of a DIMM connector having a support post mounted to a PCB surface of a motherboard according to a second exemplary embodiment.
Figure 6:
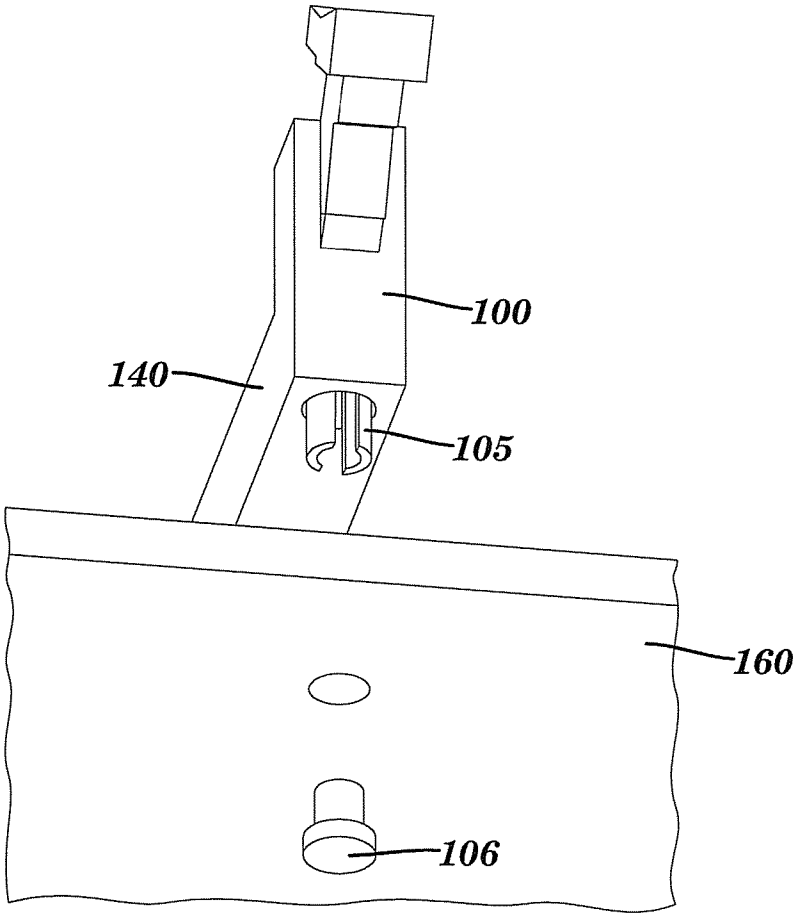
FIG. 6 illustrates an exploded isometric view of the DIMM connector of FIG. 5.

Referring now to FIGS. 4-7 illustrating a connector assembly 100 having one or more support posts in accordance with alternative exemplary embodiments to allow for rework. FIG. 4 is schematic elevation end view illustrating the structure of an electrical connector assembly 100 for a DIMM according to the present invention. In the present embodiment, connector assembly 100 utilizes one or more support posts 105. Support posts 105 are integrated to connector housing 140 by designing connector housing 140 having support posts 105 or alternatively attaching support posts 105 to connector housing 140 in a secondary process. Support posts 105 are located on the side of connector housing 140 abutting PCB 160 and are located at various distances along connector assembly 100. It is preferable that connector 100 utilize at least two support posts 105 located at either end of connector assembly 100 (e.g., on the underside of collector assembly 100 near each a corresponding latch mechanism 12). When connector assembly 100 is installed to PCB 160, support posts 105 are accepted into one or more clearance holes (not shown) in PCB 160. Support posts 105 can be press fit into the clearance holes or later soldered to the PCB, or retained by one or more retaining members 106 as shown in FIGS. 5 and 6. Retaining member 106 attaches to support post 105 on the opposite side of PCB 160 as the connector housing 140 (i.e. the back side of PCB 160).

In this embodiment of FIGS. 5 and 6, the retaining member 106 is configured as an expansion pin and is inserted into the support post 105 configured as an expansion sleeve, after reflow. The retaining member 106 and support post 105 provide an interference fit to the PCB 160 to replace the board lock used on many connectors. Then after the retaining member 106, configured as an expansion pin, is installed into the expandable sleeve, the combination provides an larger interference fit with the PCB hole, and thus anchorage of the connector assembly 100 is achieved after reflow.

This is beneficial for rework, and requires no actions that would result in a negative impact to the card/connector assembly prior to SMT attach (i.e. mis-registration of neighboring components). The risk of solder smear and similar defects is greatly reduced.

Figure 7:
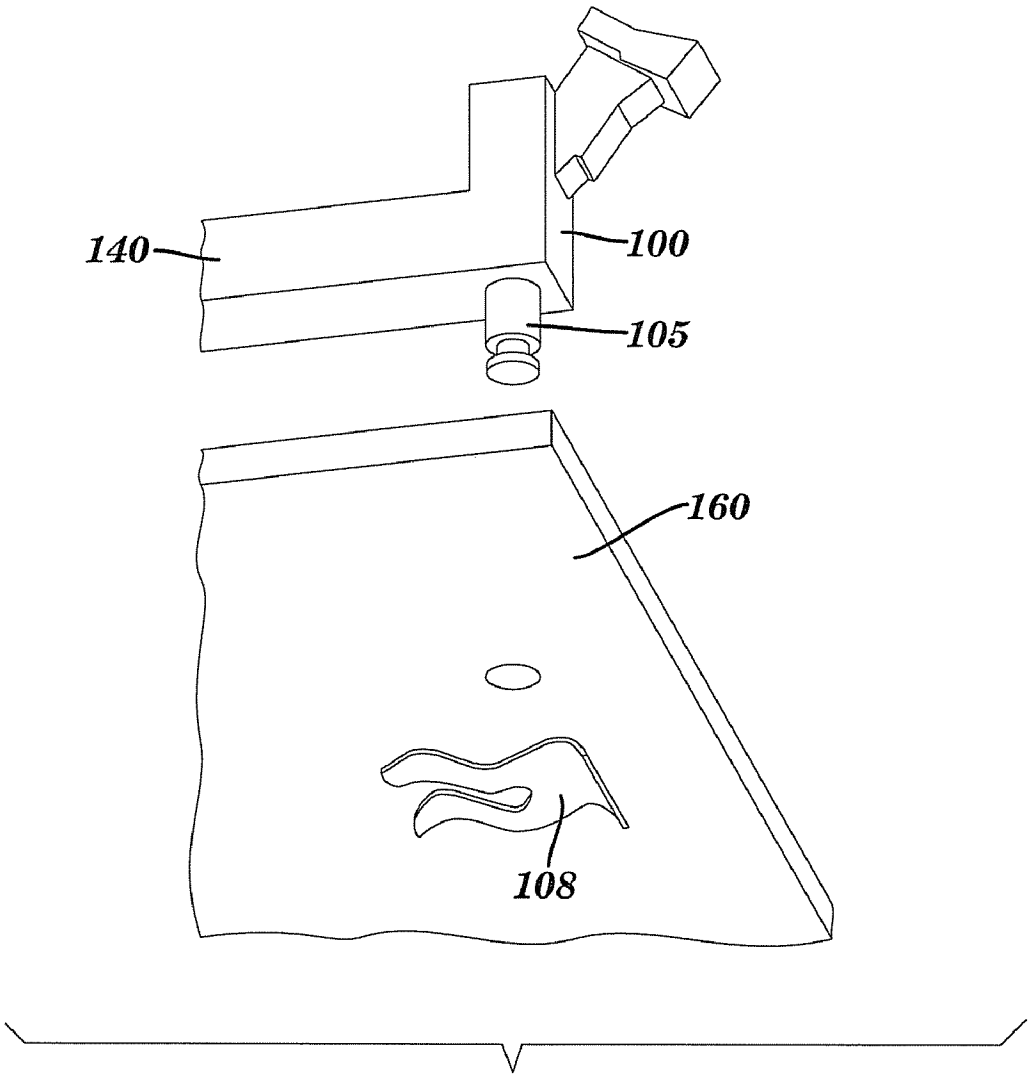
FIG. 7 illustrates an exploded isometric view of a DIMM connector to be mounted to a PCB surface of a motherboard, the connector having a support post utilizing a retaining member that retains the DIMM connector by attaching to the support post on the opposite surface of the PCB motherboard according to a fourth exemplary embodiment.

An alternative retaining member 108 is shown in FIG. 7. When a lateral force is applied to the connector body 140 in the direction of arrow 162, one or more support posts 105 act as supports transferring the lateral force to PCB 160, thereby reducing a rotational moment at a base of each connector assembly 100 connected to the PCB 160.

In this embodiment of FIG. 7, the support posts 105 extends through both sides of the PCB 160 and the retaining member 108 is configured as a compliant spring member which is inserted and locked onto the end of the support post 105, providing compression of the connector assembly housing 140 down onto the PCB 160, as well as locking the support post 105 into place. This embodiment has similar benefits provided by the embodiments of FIGS. 5 and 6, in that it is assembled post-reflow, thus having little impact on the manufacturability of the component/card assembly during reflow and can provide similar board lock functions via a raised rib on a shaft defining the support post which interferes with the PCB hole.

In exemplary embodiments, the support posts 105 of FIGS. 4-7 may simply be mold modifications to the SMT connector housing. Material selections different from that of the connector housing are not required. Thus, standard liquid crystal polymers (LCP's), high-temperature nylons, etc., are suitable for these features.

From the above described exemplary embodiments, the following attributes of the present invention are disclosed. A connector assembly includes a body having a support post extending therefrom, wherein the support post extends into a corresponding aperture of a PCB to which the connector assembly is mounted. In this manner a lateral force applied thereto is distributed across the support post which is either press-fit or soldered to the PCB thereby reducing the rotational moment at the base of each connector assembly, thus reducing a lifting stress of the connector assembly as a result of the reduced rotational moment. The support post may be placed in multiple locations for each connector assembly. More and more support posts can be used depending on the expected amount of lateral force (the more force expected, the more support posts, thereby distributing the rotational moment across all support posts.

While the preferred embodiments to the invention has been described, it will be understood that those skilled in the art, both now and in the future, may make various improvements and enhancements which fall within the scope of the claims which follow. These claims should be construed to maintain the proper protection for the invention first described.

What is claimed is:

1. An apparatus for supporting at least one electrical connector body, the apparatus comprising:

a connector housing mountable to a printed circuit board (PCB), the connector housing including;

at least one base member having a first end to receive a memory module and an opposite second end for attachment to the PCB, the base member being a single unitary indivisible unit;

at least one support post each spaced apart from one another and extending directly from the second end of the at least one base member, the support posts inserted through a first side of the PCB into one or more clearance holes in the PCB configured to receive the one or more support posts, the one or more support posts extending in a same plane as the memory module; and a fixing member on an opposite second side of the PCB configured to receive the one or more support posts and fixedly clamp the PCB between the base member and the fixing member, wherein the memory module is substantially perpendicular to PCB and when a lateral force is applied to the connector body, the support posts act as a support and transfers the lateral force to the PCB, thereby reducing rotation of the connector body about an interface of a base of each connector body connected to the PCB.

2. The apparatus of claim 1, wherein each support post and base member is integral to the connector body.

3. The apparatus of claim 1, wherein the support posts are aligned with multiple locations along the length defining the connector body.

4. The apparatus of claim 1, wherein each connector body is a DIMM connector body.

5. The apparatus of claim 1, wherein the support posts are aligned at least at opposing ends or middle portions along the length defining each of the connector bodies.

6. A system comprising:

a motherboard;

a plurality of electrical connectors surface mounted to the motherboard, each electrical connector including a connector body configured to receive and electrically connect an electrical module; the connector body including;

at least one base member having a first end to receive a memory module and an opposite second end for attachment to the motherboard, the base member being a single unitary indivisible unit;

at least one support post each spaced apart from one another and extending directly from the second of the at least one base member, the support posts inserted through a first side of the PCB into one or more clearance holes in the motherboard configured to receive the one or more support posts, the one or more support posts extending in a same plane as the electric module; and a fixing member on an opposite second side of the PCB configured to receive the one or more support posts and fixedly clamp the PCB between the base member and the fixing member, wherein the memory module is substantially perpendicular to PCB and when a lateral force is applied to the rigid connector body, the frame assembly acts as a support and transfers the lateral force to the motherboard, thereby reducing rotation of the connector body about an interface of a base of each connector body connected to the motherboard.

7. The system of claim 6, wherein each support post and base member are integral to the connector body.

8. The system of claim 6, wherein the support posts are aligned with multiple locations along the length defining the connector body.

9. The system of claim 6, wherein each connector body is a DIMM connector body.

10. The system of claim 6, wherein the support posts are aligned at least at opposing ends or middle portions along the length defining each of the connector bodies.

* * * * *